US006389932B1

(12) United States Patent
Ho

(10) Patent No.: US 6,389,932 B1
(45) Date of Patent: May 21, 2002

(54) RATCHET WRENCH

(75) Inventor: Shih-Chi Ho, Taichung Hsien (TW)

(73) Assignee: Yeh-Hsing Enterprise Co., Ltd., Taichung Hsien (TW)

( * ) Notice: Subject to any disclaimer, the term of this patent is extended or adjusted under 35 U.S.C. 154(b) by 0 days.

(21) Appl. No.: 09/697,760

(22) Filed: Oct. 27, 2000

(51) Int. Cl.[7] ..... B25B 13/46
(52) U.S. Cl. ..... 81/62; 81/63.1
(58) Field of Search ..... 81/62, 60, 61, 81/63, 63.1, 63.2; 192/43, 43.1

(56) References Cited

U.S. PATENT DOCUMENTS 5,142,953 A * 9/1992 Lin ..... 81/63
5,379,873 A * 1/1995 Shiao ..... 192/43
5,582,081 A * 12/1996 Lin ..... 81/63.1
5,609,078 A * 3/1997 Yang ..... 81/63.1
5,642,794 A * 7/1997 Chuang et al. ..... 192/43
5,910,196 A * 6/1999 Huang ..... 81/60
6,047,801 A * 4/2000 Liao ..... 192/43.2
6,151,995 A * 11/2000 Shu ..... 81/63.1
6,240,810 B1 * 6/2001 Ho ..... 81/62

* cited by examiner

*Primary Examiner*—James G. Smith
*Assistant Examiner*—Hadi Shakeri
(74) *Attorney, Agent, or Firm*—Harrison & Egbert

(57) ABSTRACT

A ratchet wrench including a main body, a shaft rod having a protruded pillar and a gear, an insertion plate, two check plates, a dial seat, and a housing. The shaft rod is provided with a skidproof head pivoted thereto. The skidproof head has a toothed hole through which the gear of the shaft rod is positioned. The shaft rod is provided in the midsegment with a rear stepped edge which is slidably disposed in an inner fitting hole of the front segment of the skidproof head. The shaft rod is further confined by a bracing element which is disposed between the rear stepped edge and the toothed hole.

1 Claim, 5 Drawing Sheets

RATCHET WRENCH

BACKGROUND OF THE INVENTION

1. Field of the Invention

The present invention relates generally to a wrench, and more particularly to a ratchet wrench.

2. Description of Related Art

As shown in FIGS. 1 and 2, a ratchet wrench 10 of the prior art has a handle 11 and a main body 12 which is provided with a center axial hole 14 with a core pillar 13 for pivoting a shaft rod 17. The shaft rod 17 is provided with a gear 15 and a core hole 16. The main body 12 is further provided with an insertion slot 18 for retaining an insertion plate 19, two check plates 20, and a dial seat 22 having two elastic press plates 21. The main body 12 is fitted into a housing 24 with a position confining hole 23. The housing 24 is provided with a notch 25 for retaining a projection 26 of the main body 12. The main body 12 is provided at the front end with a locking member 28 with a carrying hole 27.

Such a prior art ratchet wrench as described above is defective in design in that the locking member 28 is apt to unfasten to unable to control the shaft rod 17, and that the shaft rod 17 can not be easily aligned, and further that the shaft rod 17 is not structurally strong to sustain the torsion. In addition, the shaft rod 17 is complicated in construction and is therefore not cost-effective. Furthermore, the locking member 28 is apt to catch the machining chips which can inflict injuries on a person's hand at such time when the ratchet wrench 10 is in action.

BRIEF SUMMARY OF THE INVENTION

The primary objective of the present invention is to provide a ratchet wrench is free of the deficiencies of the prior art ratchet wrench described above.

The objective, features and functions of the present invention will be more readily understood upon a thoughtful deliberation of the following detailed description of the present invention with reference to the accompanying drawings.

DETAILED DESCRIPTION OF THE INVENTION

Figure 1:
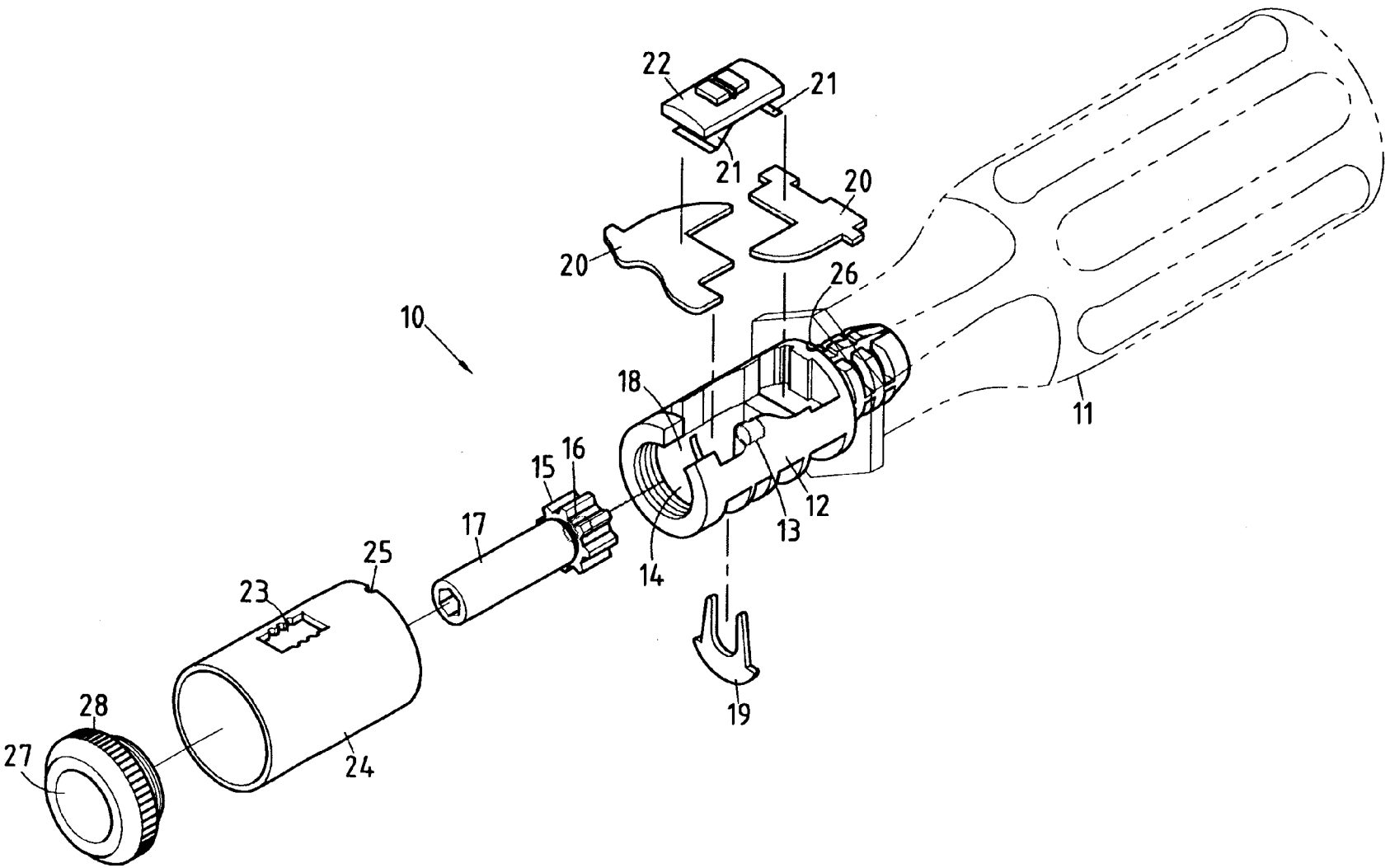
FIG.1 PRIOR ART
FIG. 1 shows an exploded view of a ratchet wrench of the prior art.
Figure 2:
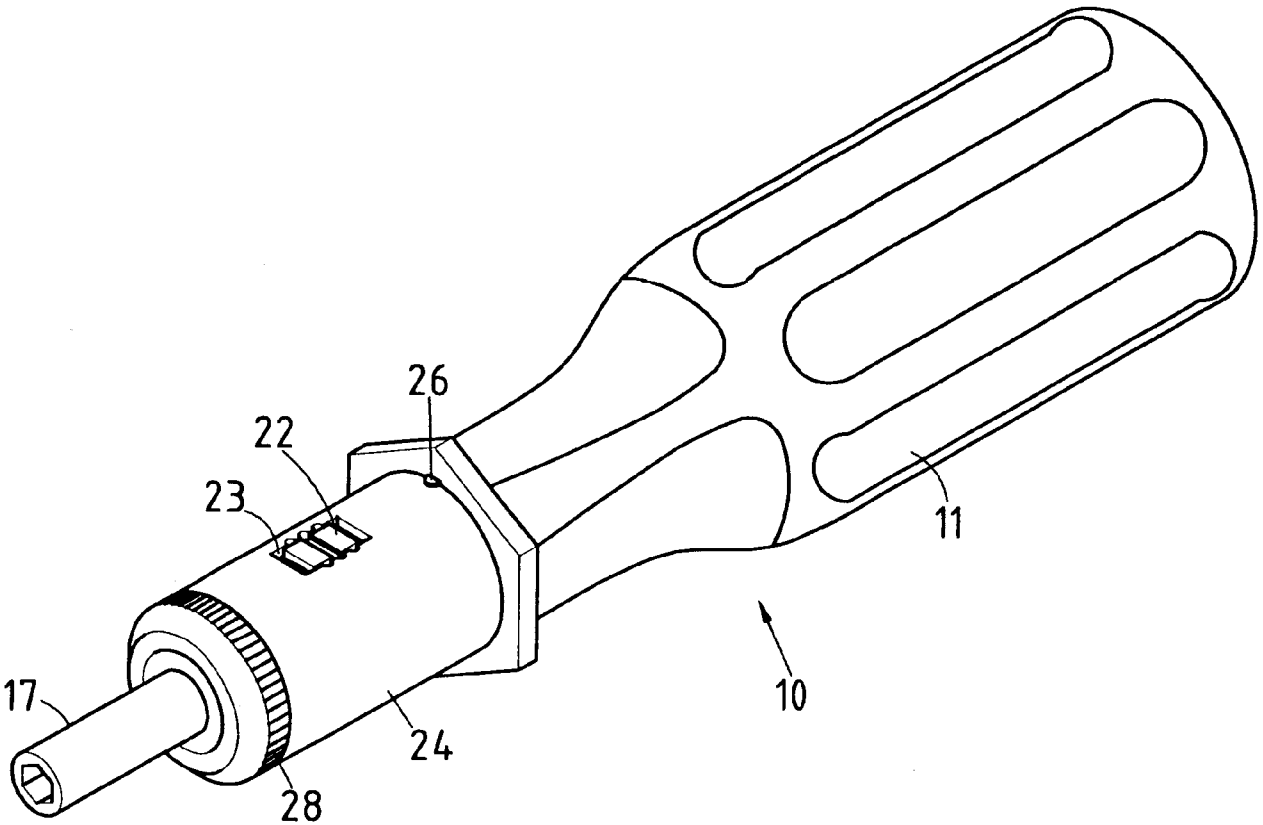
FIG.2 PRIOR ART
FIG. 2 shows a perspective view of the ratchet wrench of the prior art in combination.
Figure 3:
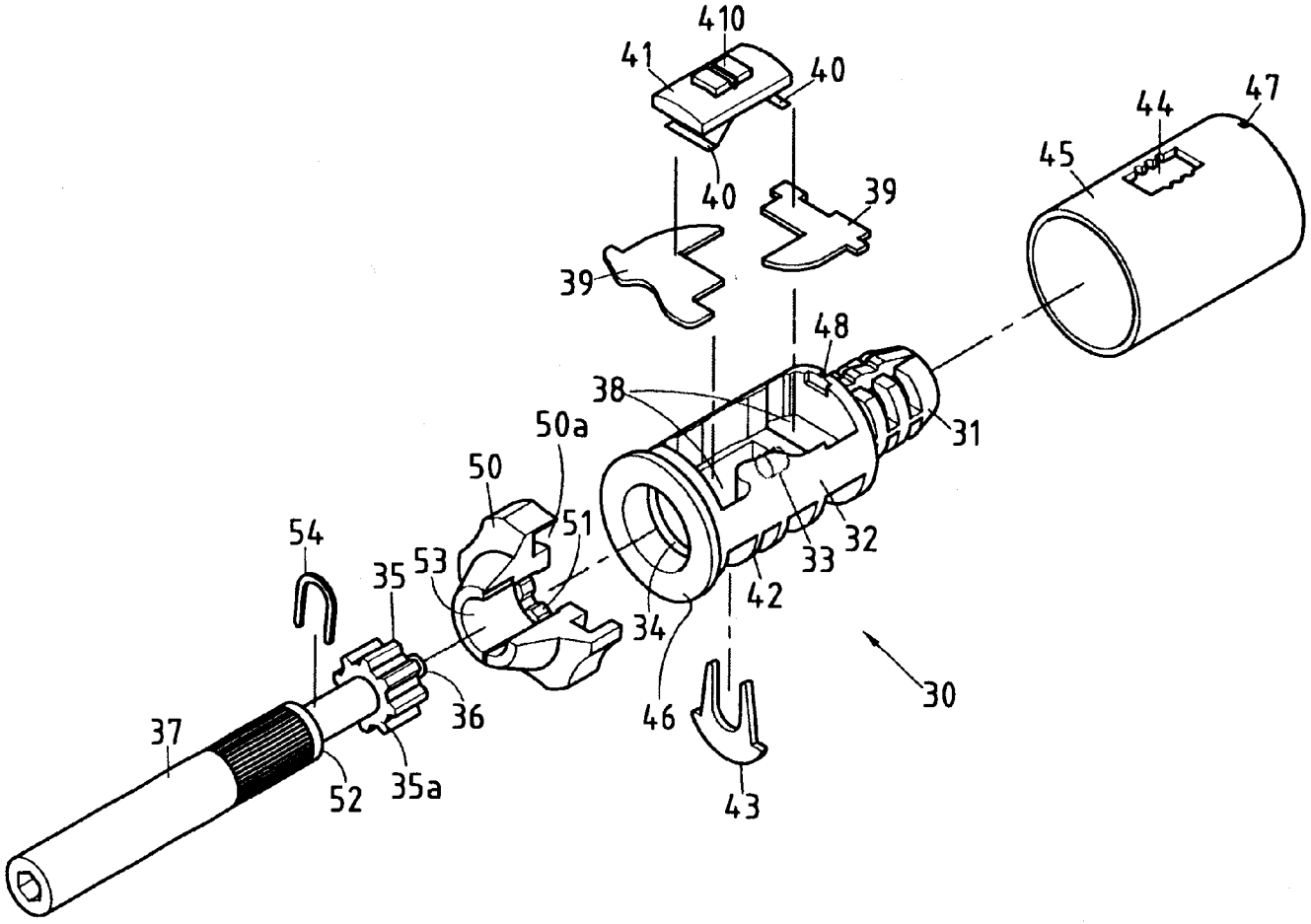
FIG. 3 shows an exploded view of a ratchet wrench of the present invention.
Figure 4:
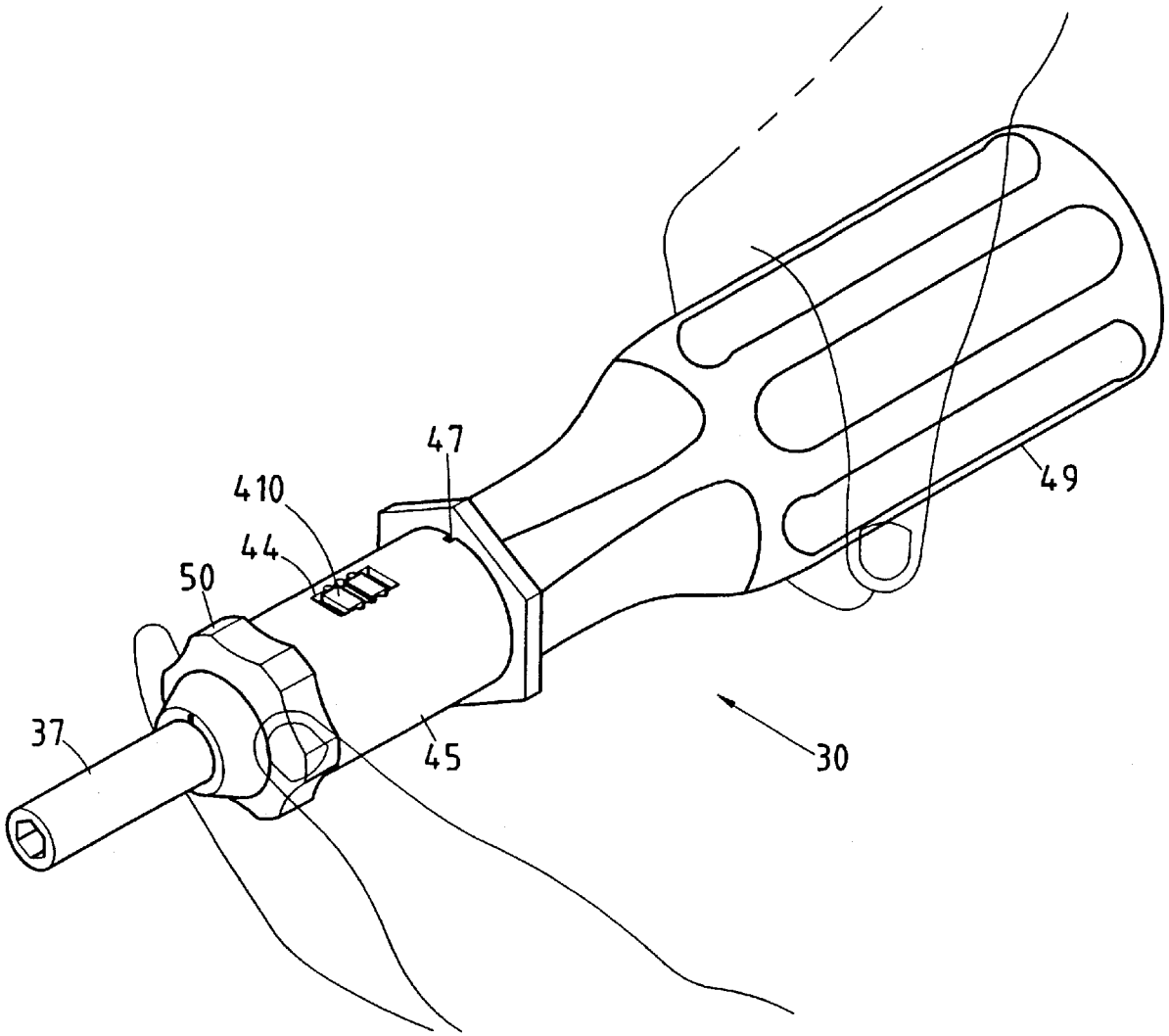
FIG. 4 shows a schematic view of the ratchet wrench of the present invention in use.
Figure 5:
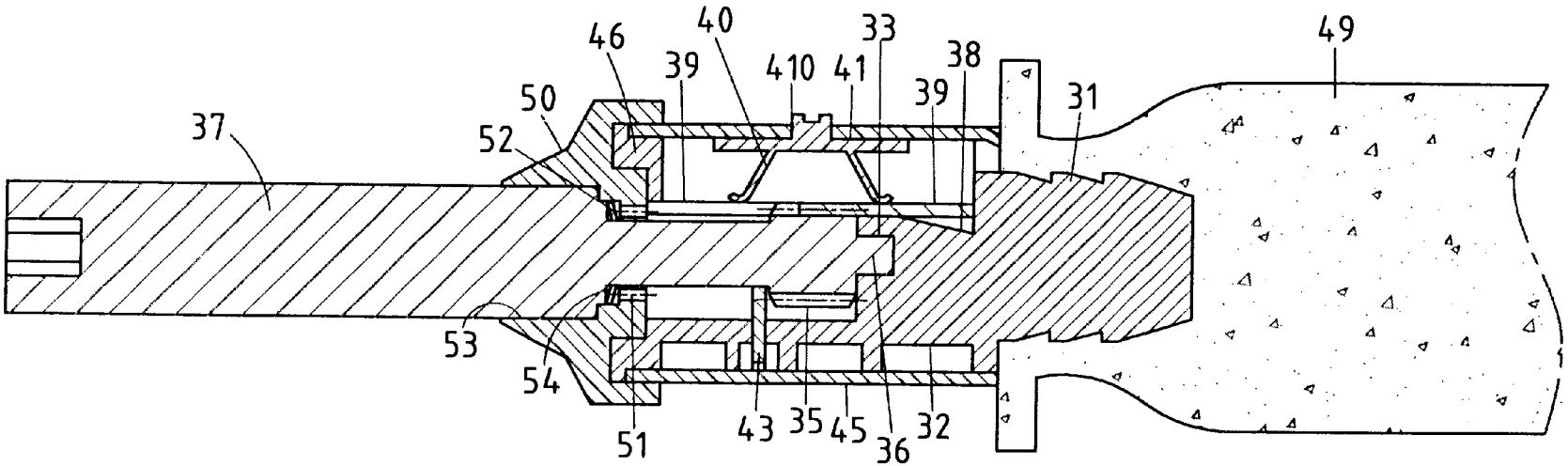
FIG. 5 shows a longitudinal sectional view of the ratchet wrench of the present invention.

As shown in FIGS. 3, 4, and 5, a ratchet wrench 30 embodied in the present invention comprises a handle, a main body, a shaft rod, a skidproof head, two check plates, a dial seat, an insertion plate, a housing and a bracing element, which are described hereinafter.

A handle 49 has a recess to receive fastening seat 31.

A main body 32 is provided at one end with a fastening seat 31 which is embedded in the handle 49, and at other end with a center axial hole 34 having a core slot 33. The main body 32 is provided in the top with two locating slots 38 in communication with the center axial hole 34. The main body 32 is further provided in the bottom with an insertion slot 42. The main body 32 has an annular protruded edge 46 located at the front thereof and provided in rear edge with a recess 48.

A shaft rod 37 is provided in the midsegment with a rear stepped edge 52, and in the tail end with a gear 35 and a protruded pillar 36. The shaft rod 37 is received in the center axial hole 34 such that the protruded pillar 36 is received in the core slot 33, and such the gear 35 is located in the center axial hole 34.

A skidproof head 50 is joined with the shaft rod 37 and is provided with a toothed hole 51 for receiving a portion of the shaft rod 37. The rear stepped edge 52 is slidably disposed in an inner fitting hole 53 of the front segment of the skidproof head 50. Located between the rear stepped edge 52 and the toothed hole 51 is a bracing element 54. Slot 50*a* on skidproof head 50 receives an end 46 of main body 32 and an end edge of housing 45.

Two check plates 39 are pivoted in the two locating slots 38 such that the check plates 39 are engaged with the gear 35.

A dial seat 41 is mounted across the two check plates 39 and is provided in the bottom with two elastic press plates 40 and in the top with a dial button 410.

An insertion plate 43 is inserted from the insertion slot 42 into the center axial hole 34 such that the insertion plate 43 is disposed at the front edge 35*a* of the gear 35.

A housing 45 is used to house the main body 32 such that the front edge of the housing 45 is stopped at the annular protruded edge 46 of the main body 32, and that the stop element 47 is received in the recess 48 of the main body 32, and further that the dial button 410 of the dial seat 41 is jutted out of the housing 45 via the position confining hole 44 of the housing 45.

The bracing element 54 is located in the inner fitting hole 53 of the skidproof head 50. The gear 35 is mounted by the insertion plate 43. The housing 45 is secured in place by the stop plate 47 and the recess 48. The axially-sliding allowance of the shaft rod 37 is eliminated by the bracing element 54 of the skidproof head 50. The shaft rod 37 is securely confined by the skidproof head 50. In addition, the structural strength of the shaft rod 37 is reinforced by the protruded pillar 36 and the core slot 33 of the center axial hole 34.

I claim:

1. A ratchet wrench comprising:

a handle;

a main body having a fastening seat at one end and a center axial hole at an opposite end, said fastening seat retained in said handle, said main body having a core slot at an end of said center axial hole, said main body having two locating slots formed therein in communication with said center axial hole, said main body having an annular protruding edge at a front end thereof, said main body having an insertion slot and a recess;

a shaft rod having a stepped portion at a midsegment thereof, said shaft rod having a gear at a tail end thereof, said shaft rod having a protruded pillar extending outwardly from said gear, said shaft rod being received in said center axial hole such that said protruded pillar is received in said core slot, said gear being positioned in said center axial hole;

a skidproof head receiving said shaft rod, said skidproof head having a toothed hole, said shaft rod having a portion between said gear and said stepped portion extending through said toothed hole, said skidproof head having an inner fitting hole receiving said stepped portion of said shaft rod therein, said skidproof head having an annular slot formed at an end thereof, said annular slot receiving an end of said main body therein;

a bracing element affixed between said stepped portion of said shaft rod and said toothed hole;

two check plates respectively received in said two locating slots, said two check plates engaged with said gear;

a dial seat mounted across said two check plates, said dial seat having two elastic press plates and a dial button;

an insertion plate disposed in said center axial holes such that said insertion plate is positioned at a front edge of said gear; and a housing covering said main body such that a front edge of said housing is stopped at said annular protruded edge of said main body, said housing having a stop element received within said recess of said main body, said dial button of said dial seat extending outwardly through a hole in said housing, said housing having an end edge received within said annular slot of said skidproof head.

* * * * *